US006210306B1

(12) United States Patent
Miller

(10) Patent No.: US 6,210,306 B1
(45) Date of Patent: Apr. 3, 2001

(54) COLLAPSIBLE EXERCISE WALKING DEVICE FOR SEMI-TRUCKS

(76) Inventor: Paul D. Miller, 2200 Corona Ave., Norco, CA (US) 91760

( * ) Notice: Subject to any disclaimer, the term of this patent is extended or adjusted under 35 U.S.C. 154(b) by 0 days.

(21) Appl. No.: 09/564,721

(22) Filed: May 4, 2000

(51) Int. Cl.[7] ..... A63B 22/02
(52) U.S. Cl. ..... 482/54
(58) Field of Search ..... 482/54, 904, 51, 482/148

(56) References Cited

U.S. PATENT DOCUMENTS

| | | | | |
|---|---|---|---|---|
| D. 369,843 | | 5/1996 | Wang et al. . | |
| 1,919,627 | | 7/1933 | Gerald . | |
| 4,679,787 | * | 7/1987 | Guilbault | 482/54 |
| 5,558,608 | * | 9/1996 | Hall | 482/904 |
| 5,662,560 | * | 9/1997 | Svendsen et al. | 482/54 |
| 5,711,745 | | 1/1996 | Yang . | |
| 5,782,723 | * | 7/1998 | Kuo | 482/54 |
| 5,813,947 | * | 9/1998 | Densmore | 482/51 |

* cited by examiner

*Primary Examiner*—Stephen R. Crow

(57) ABSTRACT

A collapsible exercise walking device for semi-trucks for providing an exercise device which may be hidden in the sleeping compartment of a semi-truck. The collapsible exercise walking device for semi-trucks includes a treadmill assembly. The treadmill assembly has a pair of opposite ends. The treadmill assembly is adapted for a person walking in place thereon. The treadmill assembly has a handle member rotatably coupled thereto such that the handle member may be selectively moved to a collapsed position. A rail assembly slidably moves the treadmill assembly. The rail assembly comprises a pair of elongate brackets. Each of the brackets is spaced and oriented generally parallel to each other. Each of the brackets is removably coupled to a floor of the sleeping cabin. Each of the brackets has a rail member thereon. The rail members generally face each other. A plurality of wheels is each coupled to one of the ends of the treadmill assembly. The wheels are adapted to roll along the rail members such that the treadmill assembly may be moved between opposite ends of the elongate brackets.

6 Claims, 2 Drawing Sheets

COLLAPSIBLE EXERCISE WALKING DEVICE FOR SEMI-TRUCKS

BACKGROUND OF THE INVENTION

1. Field of the Invention

The present invention relates to exercise walking devices and more particularly pertains to a new collapsible exercise walking device for semi-trucks for providing an exercise device which may be hidden in the sleeping compartment of a semi-truck.

2. Description of the Prior Art

The use of exercise walking devices is known in the prior art. More specifically, exercise walking devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,813,947; U.S. Pat. No. 4,679,787; U.S. Pat. No. 1,919,627; U.S. Pat. No. 5,558,608; U.S. Pat. No. 5,711,745; and U.S. Des. Pat. No. 369,843.

While these devices fulfill their respective, particular objectives and requirements, the aforementioned patents do not disclose a new collapsible exercise walking device for semi-trucks. The inventive device includes a treadmill assembly. The treadmill assembly has a pair of opposite ends. The treadmill assembly is adapted for a person walking in place thereon. The treadmill assembly has a handle member rotatably coupled thereto such that the handle member may be selectively moved to a collapsed position. A rail assembly slidably moves the treadmill assembly. The rail assembly comprises a pair of elongate brackets. Each of the brackets is spaced and oriented generally parallel to each other. Each of the brackets is removably coupled to a floor of the sleeping cabin. Each of the brackets has a rail member thereon. The rail members generally face each other. A plurality of wheels is each coupled to one of the ends of the treadmill assembly. The wheels are adapted to roll along the rail members such that the treadmill assembly may be moved between opposite ends of the elongate brackets.

In these respects, the collapsible exercise walking device for semi-trucks according to the present invention substantially departs from the conventional concepts and designs of the prior art, and in so doing provides an apparatus primarily developed for the purpose of providing an exercise device which may be hidden in the sleeping compartment of a semi-truck.

SUMMARY OF THE INVENTION

In view of the foregoing disadvantages inherent in the known types of exercise walking devices now present in the prior art, the present invention provides a new collapsible exercise walking device for semi-trucks construction wherein the same can be utilized for providing an exercise device which may be hidden in the sleeping compartment of a semi-truck.

The general purpose of the present invention, which will be described subsequently in greater detail, is to provide a new collapsible exercise walking device for semi-trucks apparatus and method which has many of the advantages of the exercise walking devices mentioned heretofore and many novel features that result in a new collapsible exercise walking device for semi-trucks which is not anticipated, rendered obvious, suggested, or even implied by any of the prior art exercise walking devices, either alone or in any combination thereof.

To attain this the present invention generally comprises a treadmill assembly. The treadmill assembly has a pair of opposite ends. The treadmill assembly is adapted for a person walking in place thereon. The treadmill assembly has a handle member rotatably coupled thereto such that the handle member may be selectively moved to a collapsed position. A rail assembly slidably moves the treadmill assembly. The rail assembly comprises a pair of elongate brackets. Each of the brackets is spaced and oriented generally parallel to each other. Each of the brackets is removably coupled to a floor of the sleeping cabin. Each of the brackets has a rail member thereon. The rail members generally face each other. A plurality of wheels is each coupled to one of the ends of the treadmill assembly. The wheels are adapted to roll along the rail members such that the treadmill assembly may be moved between opposite ends of the elongate brackets.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new collapsible exercise walking device for semi-trucks apparatus and method which has many of the advantages of the exercise walking devices mentioned heretofore and many novel features that result in a new collapsible exercise walking device for semi-trucks which is not anticipated, rendered obvious, suggested, or even implied by any of the prior art exercise walking devices, either alone or in any combination thereof.

It is another object of the present invention to provide a new collapsible exercise walking device for semi-trucks which may be easily and efficiently manufactured and marketed.

It is a further object of the present invention to provide a new collapsible exercise walking device for semi-trucks which is of a durable and reliable construction.

An even further object of the present invention is to provide a new collapsible exercise walking device for semi-trucks which is susceptible of a low cost of manufacture with regard to both materials and labor, and which accordingly is then susceptible of low prices of sale to the consuming public, thereby making such collapsible exercise walking device for semi-trucks economically available to the buying public.

Still yet another object of the present invention is to provide a new collapsible exercise walking device for semi-trucks which provides in the apparatuses and methods of the prior art some of the advantages thereof, while simultaneously overcoming some of the disadvantages normally associated therewith.

Still another object of the present invention is to provide a new collapsible exercise walking device for semi-trucks for providing an exercise device which may be hidden in the sleeping compartment of a semi-truck.

Yet another object of the present invention is to provide a new collapsible exercise walking device for semi-trucks which includes a treadmill assembly. The treadmill assembly has a pair of opposite ends. The treadmill assembly is adapted for a person walking in place thereon. The treadmill assembly has a handle member rotatably coupled thereto such that the handle member may be selectively moved to a collapsed position. A rail assembly slidably moves the treadmill assembly. The rail assembly comprises a pair of elongate brackets. Each of the brackets is spaced and oriented generally parallel to each other. Each of the brackets is removably coupled to a floor of the sleeping cabin. Each of the brackets has a rail member thereon. The rail members generally face each other. A plurality of wheels is each coupled to one of the ends of the treadmill assembly. The wheels are adapted to roll along the rail members such that the treadmill assembly may be moved between opposite ends of the elongate brackets.

Still yet another object of the present invention is to provide a new collapsible exercise walking device for semi-trucks that may be stores in any small compartment as under the beds in a motor home, a boat or a sleeping compartment of a semi-truck.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
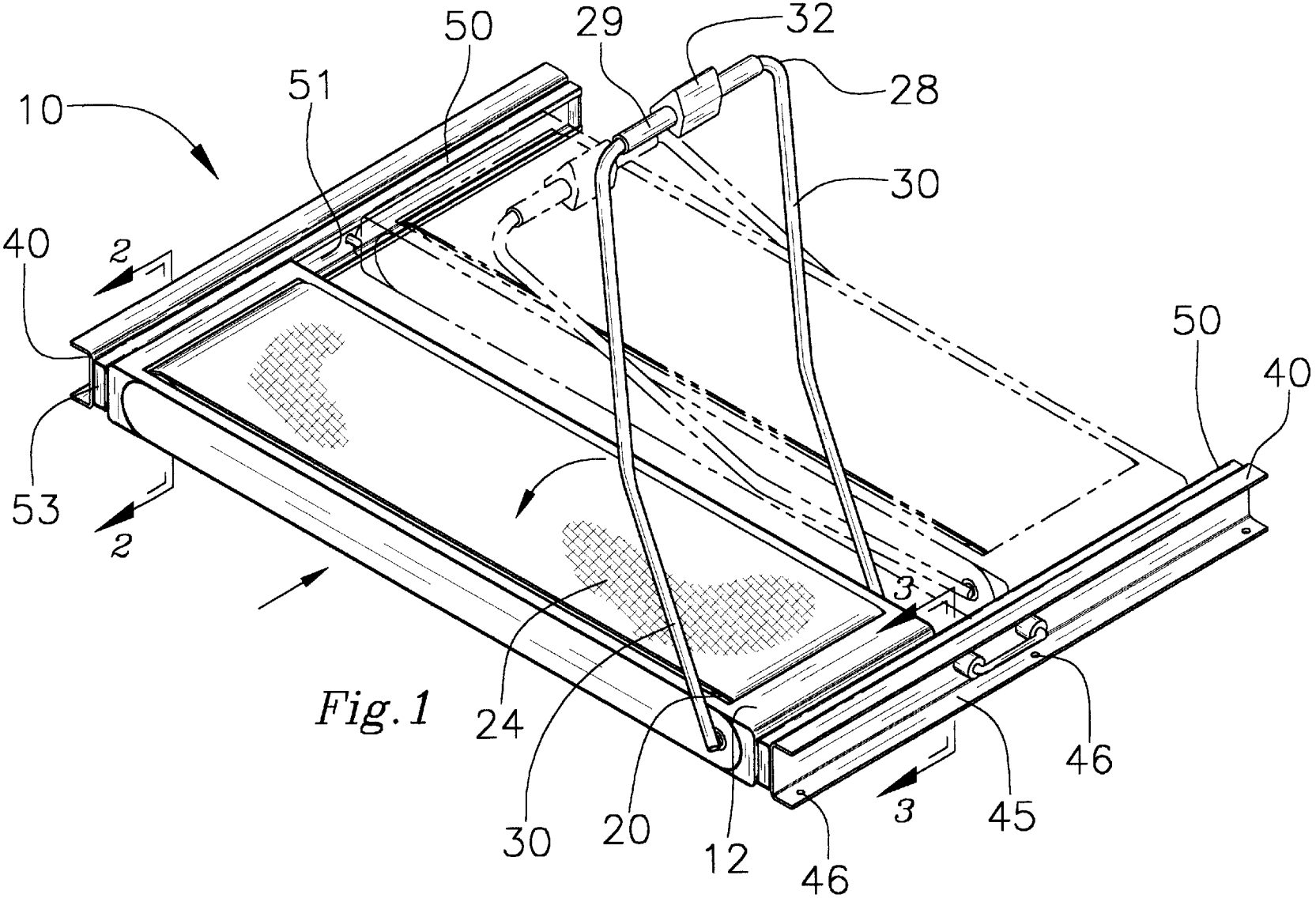
FIG. 1 is a schematic perspective view of a new collapsible exercise walking device for semi-trucks according to the present invention.
Figure 2:
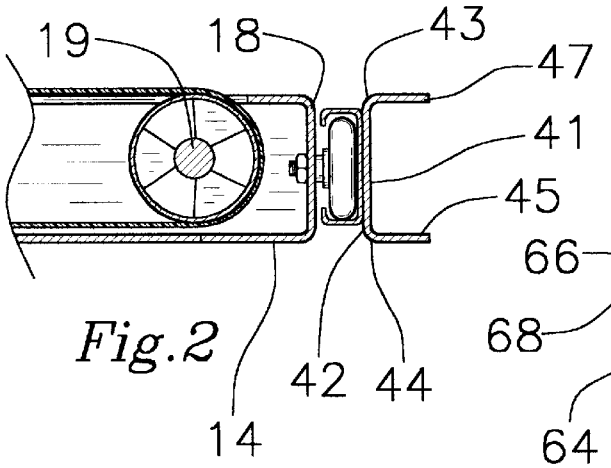
FIG. 2 is a schematic cross-sectional view taken along line 2—2 of the present invention.
Figure 3:
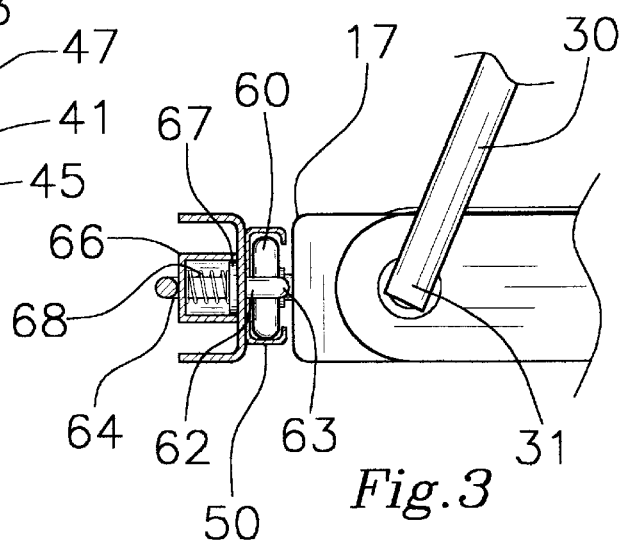
FIG. 3 is a schematic cross-sectional view taken along line 3—3 of the present invention.

With reference now to the drawings, and in particular to FIGS. 1 through 4 thereof, a new collapsible exercise walking device for semi-trucks embodying the principles and concepts of the present invention and generally designated by the reference numeral will be described.

As best illustrated in FIGS. 1 through 4, the collapsible exercise walking device for semi-trucks 10 generally comprises a treadmill assembly which may be rolled along rails under a bed in a confined space such as the sleeping compartment of a semi-trailer.

The treadmill assembly comprises conventional treadmill type walking assembly having a housing 12. The housing 12 has a bottom wall 14, a first side wall 15, a second side wall 16, a first end wall 17 and a second end wall 18. A top portion of the housing 12 is substantially open.

A pair of rollers 19, 20 each has a first 21 and second 22 end. Each of rollers 19, 20 has a first end 21 rotatably coupled to an interior surface of the first side wall 15 and a second end 22 rotatably coupled to an interior surface of the second side wall 16. Each of the rollers 19, 20 is substantially adjacent to one of the end walls 17, 18. A walking belt 24 is comprises a continues loop, which is wrapped about rollers.

A motor 23 is mounted in the housing 12. The motor 23 is operatively coupled to a first of the rollers 19 such that the motor 23 may rotate the first roller 19. The motor 23 is adapted to operate at varying speeds.

A power supply 25 supplies power to the motor. The power supply is a cord having a first end 26 operatively coupled to the motor and a second end 27 has an adapter thereon adapted to couple to a cigarette lighter port of a vehicle.

A handle member 28 has a middle portion 29 and two leg portions 30. Each of the leg portions 30 has a first end coupled to an opposite end of the middle portion 29 and each leg portion 30 extends away from the middle portion 29 in a generally parallel direction. Each of the leg portions 30 has a second end 31 rotatably coupled to one of the outside surfaces of the first 15 and second 16 side walls. Each of the second ends of the leg portions is generally positioned adjacent to the second roller 20.

An actuating means 32 turns the motor 23 on and off. The actuating means 32 is operationally coupled to the motor 23. The actuating means 32 is mounted to the handle member. The actuating means 32 is adapted to control the varying speeds of the motor 23, and may be equipped with a screen to display, among other items, speed, distance, difficulty level and calories expended.

A rail assembly allows the treadmill assembly to slidably roll under a bed. The rail assembly comprises a pair of elongate brackets and a pair of rail members.

The pair of elongate brackets 40 each has a front side 41, a back side 42, a top edge 43 and a bottom edge 44. Each of the bottom edges 44 has a lip 45 thereon. Each of the lips 45 extends away from the front side 41 and is orientated generally perpendicular to the front side 41. Each of the lips 45 has a plurality of holes 46 therein. A plurality of fastening means fasten the brackets to a floor of the sleeping cabin. The fastening means are preferably screws or bolts extending through the holes 46 such that the back sides 42 of the brackets are directed toward each other and the brackets are orientated generally parallel to each other. Ideally, the top edge 43 has a lip 47 thereon on as well such that the elongate brackets 40 are generally U-shaped to prevent injury by someone stepping on the top edge.

Each of the pair of rail members 50 is coupled to one of the back sides 42 of the brackets 40. Each of the rail members 50 comprises an elongate rail having a slot 51 therein. An aperture 52 extends through one of the brackets 40 and a respective rail member 50. The aperture 52 is located generally between opposite ends of the bracket 40. Each of the slots 51 is adapted for receiving a wheel. The rail members 50 are also preferably U-shaped and have walls 53 at each end. The rail members 50 face the opposite direction of the U-shaped brackets 40.

A plurality of wheels 60 are coupled to each one of the outside surfaces of the first 18 and second 18 ends walls. Each of the wheels 60 has an axis of rotation orientated generally perpendicular to the first 18 and second 20 end walls. The brackets 40 are positioned such that the wheels 60 on one of the end walls are located within the slot 51 of one of the rail members 50 and such that the wheels 60 on the other of the end walls are located within the slot 51 of the other of the rail members 50. The treadmill assembly 12 may slidably move between a pair of opposite ends of the slots 51.

Figure 4:
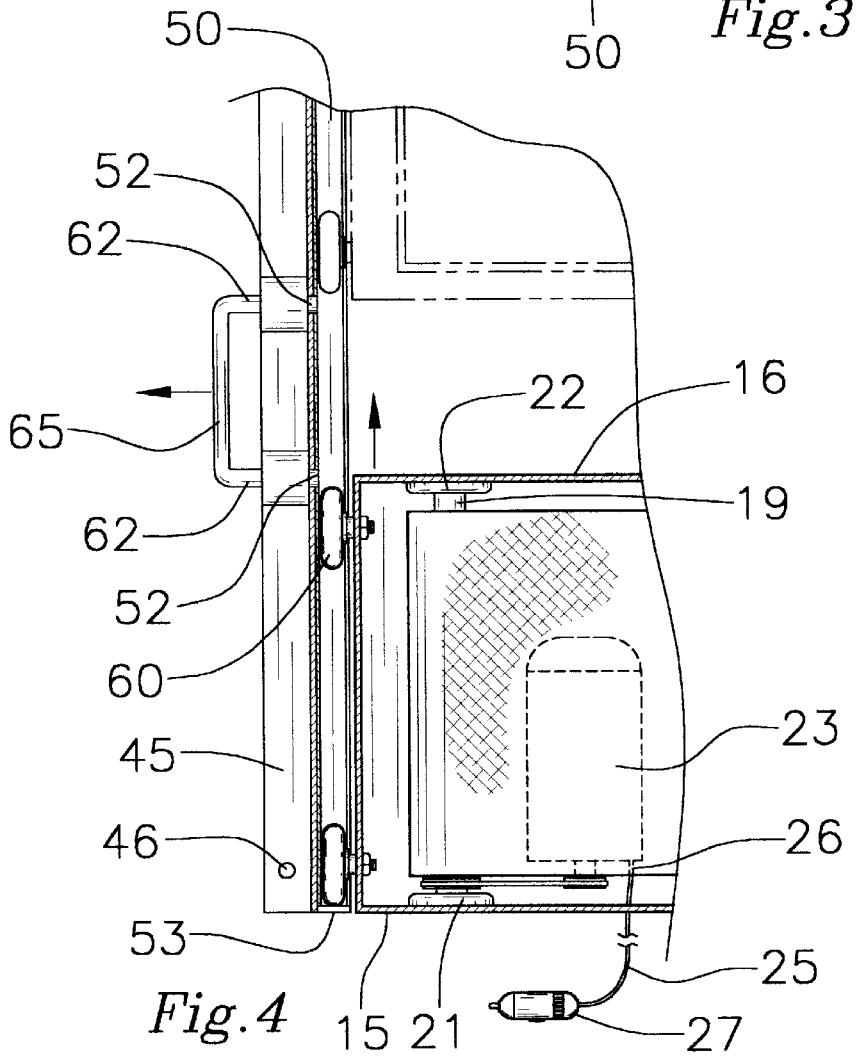
FIG. 4 is a schematic top view of the present invention.

A locking means selectively locks the treadmill assembly in a position generally adjacent to a first or second end of the slots. The locking means comprises a rod 62. The rod 62 has a first end 63 and second end 64. The rod 62 slidably extends through the aperture 51 such that the first end 63 of the rod 62 extends into the slot 52 whereby the wheels 60 may not travel by the rod 62. A biasing means biases the first end 63 of the rod 62 into the slot 51. Preferably, as shown in FIG. 4, two rods are used which have second ends 64 coupled together by a handle 65. Each rod 62 has its own aperture 52 to extend through. The rods 62 travel through a housing 66. Each of the rods has a middle portion having a disc 67 thereon for urging against by the biasing means which is preferably a spring 68 mounted in the housing 66.

In use, the treadmill 12 is stored under a bed in the sleeping cabin of a semi-trailer. The rod 62 is pulled out of the slot 51 so that the treadmill 12 may roll to an opposite end of the bracket 40 away from the bed. The treadmill 12 is then used as any conventional treadmill.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A collapsible exercise walking device, said device being slidably placeable under a bed in a sleeping cabin of a semi-truck, said device comprising:

a treadmill assembly, said treadmill assembly having a pair of opposite ends, said treadmill assembly being adapted for a person walking in place thereon, said treadmill assembly having a handle member rotatably coupled thereto such that said handle member may be selectively moved to a collapsed position;

a rail assembly for slidably moving said treadmill assembly, said rail assembly comprising:

a pair of elongate brackets, each of said brackets being spaced and oriented generally parallel to each other, each of said brackets being removably coupled to a floor of said sleeping cabin, each of said brackets having a rail member thereon, said rail members generally facing each other; and a plurality of wheels, each of said wheels being coupled to one of said ends of said treadmill assembly, said wheels being adapted to roll along said rail members such that said treadmill assembly may be moved between opposite ends of said elongate brackets.

2. The collapsible exercise walking device as in claim 1, wherein said pair of elongate brackets further comprises:

each of said brackets having a front side, a back side, a top edge and a bottom edge, each of said bottom edges having a lip thereon, each of said lips extending away from said front side and being orientated generally perpendicular to said front side, each of said lips having a plurality of holes therein, a plurality of fastening means for fastening said brackets to a floor of the sleeping cabin, said fastening means extending through said holes such that said back sides of said brackets are directed toward each other and said brackets are orientated generally parallel to each other.

3. The collapsible exercise walking device as in claim 2, wherein said pair of rail members further comprises:

each of said rail members being coupled to one of said back sides of said brackets, each of said rail members comprising an elongate rail having a slot therein, each of said slots being adapted for receiving a wheel.

4. The collapsible exercise walking device as in claim 3, wherein said plurality of wheels further comprises:

each of said wheels having an axis of rotation orientated generally perpendicular to said pair of opposite ends of said treadmill, wherein said brackets are positioned such that said wheels on one of said end walls are located within one of said rail members and such that said wheels on the other of said end walls are located within the other of said rail members, wherein said treadmill assembly may slidably move between a pair of opposite ends of said slots.

5. The collapsible exercise walking device as in claim 1, further comprising:

an aperture extending through one of said brackets and a respective rail member, said aperture being located generally between opposite ends of said bracket; and a locking means for selectively locking said treadmill assembly in a position generally adjacent to a first or second end of said slots, said locking means comprising a rod, said rod having a first end and second end, said rod slidably extending through said aperture such that said first end of said rod extends beyond said rail member whereby said wheels may not travel by said rod.

6. A collapsible exercise walking device, said device being slidably placeable under a bed in a sleeping cabin of a semi-truck, said device comprising:

a treadmill assembly, said treadmill assembly comprising:

a housing, said housing having a bottom wall, a first side wall, a second side wall, a first end wall and a second end wall, a top portion of said housing being substantially open;

a pair of rollers, each of said rollers having a first and second end, each of rollers having a first end rotatably coupled to an interior surface of said first side wall and a second end rotatably coupled to an interior surface of said second side wall, each of said rollers being substantially adjacent to one of said end walls; a walking belt comprises a continues loop, said walking belt being is wrapped about and extending between said rollers;

a motor, said motor being mounted in said housing, said motor being operatively coupled to a first of said rollers such that said motor may rotate said first roller, said motor being adapted to operate at varying speeds;

a power supply for supplying power to said motor, said power supply being a cord having a first end operatively coupled to said motor and a second end having an adapter thereon adapted to couple to a cigarette lighter port of a vehicle;

a handle member, said handle member having a middle portion and two leg portions, each of said leg portions having a first end coupled to an opposite end of said middle portion and extending away from said middle portion in a generally parallel direction, each of said leg portions having a second end rotatably coupled to one of said outside surfaces of said first and second side walls, each of said second ends of said leg portions being generally positioned adjacent to said second roller;

an actuating means for turning said motor on and off, said actuating means being operationally coupled to said motor, said actuating means being mounted to said handle member;

a rail assembly for slidably moving said treadmill assembly, said rail assembly comprising:

a pair of elongate brackets, each of said brackets having a front side, a back side, a top edge and a bottom edge, each of said bottom edges having a lip thereon, each of said lips extending away from said front side and being orientated generally perpendicular to said front side, each of said lip having a plurality of holes therein, a plurality of fastening means for fastening said brackets to a floor of the sleeping cabin, said fastening means extending through said holes such that said back sides of said brackets are directed toward each other and said brackets are orientated generally parallel to each other;

a pair of rail members, each of said rail members being coupled to one of said back sides of said brackets, each of said rail members comprising an elongate rail having a slot therein, an aperture extending through one of said brackets and a respective rail member, said aperture being located generally between opposite ends of said bracket, each of said slots being adapted for receiving a wheel;

a plurality of wheels, each of said wheels being coupled to one of said outside surfaces of said first and second ends walls, each of said wheels having an axis of rotation orientated generally perpendicular to said first and second end walls, wherein said brackets are positioned such that said wheels on one of said end walls are located within one of said rail members and such that said wheels on the other of said end walls are located within the other of said rail members, wherein said treadmill assembly may slidably move between a pair of opposite ends of said slots;

a locking means for selectively locking said treadmill assembly in a position generally adjacent to a first or second end of said slots, said locking means comprising a rod, said rod having a first end and second end, said rod slidably extending through said aperture such that said first end of said rod extends into said slot whereby said wheels may not travel by said rod, a biasing means biases said first end of said rod into said slot.

* * * * *